United States Patent [19]

Prazak, III

[11] 3,984,902

[45] Oct. 12, 1976

[54] APPARATUS FOR COATING SKIRTLESS CATHODE RAY TUBE PANELS

[75] Inventor: Charles J. Prazak, III, Elmhurst, Ill.

[73] Assignee: Zenith Radio Corporation, Chicago, Ill.

[22] Filed: Jan. 5, 1976

[21] Appl. No.: 646,459

[52] U.S. Cl. ..... 29/25.19; 29/25.17; 118/DIG. 4; 427/420

[51] Int. Cl.[2] ..... H01J 9/06

[58] Field of Search ..... 29/25.17, 25.19; 427/64, 68, 157, 420; 118/DIG. 4, 319, 324

[56] References Cited

UNITED STATES PATENTS 2,745,419 5/1956 Slingerland ..... 118/DIG. 4

3,876,465 4/1975 Prazale et al. ..... 118/DIG. 4

*Primary Examiner*—Richard B. Lazarus

*Attorney, Agent, or Firm*—John H. Coult

[57] ABSTRACT

This disclosure depicts curtain coating apparatus for applying a coating of phosphor or other CRT screen material to the concave inside surface of a curved skirtless cathode ray tube front panel. The apparatus conveys the panel through a curtain of the coating material with its concave surface facing upwardly. The path along which the panel is conveyed (and thus the panel motion) is such as to produce a high degree of uniformity in the coating received by the panel.

10 Claims, 12 Drawing Figures

Reservoir

APPARATUS FOR COATING SKIRTLESS CATHODE RAY TUBE PANELS

CROSS REFERENCE TO RELATED APPLICATION

This application discloses and claims an invention of mine disclosed in my application Ser. No. 340,634, filed Mar. 12, 1973 (now U.S. Pat. No. 3,876,465). That application, as filed, contained apparatus and method claims. As a result of a restriction requirement by the Patent and Trademark Office, the patent was issued with method claims only. This application is drawn to the apparatus disclosed therein.

BACKGROUND OF THE INVENTION

The present invention pertains generally to the manufacture of cathode ray tubes. It is specifically directed toward improved apparatus for depositing phosphor or other material coatings onto the front panels of such tubes.

Picture tubes of the type with which this invention is concerned consist of two separate units, a front panel assembly and a funnel assembly, each manufactured and processed separately, which are ultimately united. In conventional color picture tubes, the front panel assembly includes a glass front panel having a 2 to 3 inch glass skirt around its perimeter and an aperture mask assembly comprising an aperture (shadow) mask mounted on and supported by a steel frame which is in turn supported and positioned within the front panel by studs extending inwardly from the panel skirt. A glass funnel which comprises part of the funnel assembly mates with the front panel and is frit-sealed thereto.

One phase of the manufacture of cathode ray tubes, both black-and-white and color, involves depositing one or more phosphor coatings onto the front panels of such tubes. In the case of color tubes, successive coatings of green-emitting, blue-emitting and red-emitting phosphor materials are applied to each front panel. A most common way of applying such phosphor coatings on cathode ray tube (CRT) front panels has been to dispense a phosphor slurry into an inverted front panel. The panel is then tilted and spun in a manner well known in the art in order to provide a uniform slurry coating over the inner surface of the panel. The panel is then tilted further in order to dump any excess slurry.

This "dispense and spin" method, although subject to certain disadvantages, has found considerable application in the commercial production of color CRT's. While this method is reasonably well suited for processing conventional skirted panels, it is not well suited for processing a new type of CRT front panel which has no skirt around its perimeter. A fuller discussion of such new panels and the reasons why the dispense and spin method of phosphor coating is unsuitable for them will be deferred until certain problems which are associated with the dispense and spin method have been examined. This will help to clarify the objectives of the present invention and to illuminate the particular problems to which the invention is addressed.

One problem which contributes to the high cost of manufacturing CRT's is that the dispense and spin method, as practiced in the manner described above, is a relatively slow process. The total time required for the application of one coating is in the order of one or two minutes. In color tube screening, the process must be repeated for each of the three phosphor materials, resulting in a total elapsed time for the application of the phosphor coatings, exclusive of the time required for exposure, developing and drying, of 5 minutes or more.

Another problem which exists in the above-described dispense and spin method of phosphor coating is that any contaminants which are found on the panel will be mixed in with the dispensed slurry and may find their way back into the phosphor source when the excess slurry is dumped and reclaimed. Since this reclaimed slurry is generally reused, those contaminants can be undesirably recycled back onto another panel where their presence may cause pock marks or other disturbances in the coating. Such irregularities in phosphor coatings can cause a significant drop in the production yield factor, thus adding to the per unit cost of the finished product.

A third disadvantage which is inherent in the dispense and spin procedure is that the excess slurry which is dumped and reclaimed has a phosphor content which is less than that of an unused slurry. This is because the phosphor particles which are suspended within the slurry tend to settle onto the panel surface. A certain amount of phosphor material must, therefore, be added to the reclaimed slurry before it can be reused. The added step of restoring the reclaimed slurry to its former state further complicates an already complex process. In addition to complicating the entire process, this step is subject to erros which can adversely affect product uniformity and yield.

A fourth problem with this method of applying the phosphor coating is that during the coating of the panel, the larger phosphor particles tend to settle our first. When the excess slurry is dumped, it will contain fewer of the large phosphor particles than an unused slurry and, if mixed directly with that unused slurry, may cause subsequent panels to receive coatings which do not have the desired phosphor particle distribution. This problem, along with the one discussed immediately above, tend to cause long term process variations which result in nonuniform phosphor weight distributions in panel coatings. Such variations are particularly evident between panels processed soon after production start-up and those processed later.

This invention is directed toward apparatus well suited for the application of coatings of phosphor and other materials onto skirtless CRT panels while avoiding the above-described problems which are associated with the application of phosphor coatings onto conventional skirted CRT panels.

| Prior Art PATENT NUMBER | ISSUED TO |
|---|---|
| 771,443 | Perkiewicz |
| 1,200,065 | Yingling |
| 2,745,419 | Slingerland |
| 2,916,012 | Hergenrother |
| 3,132,968 | Wandtke |
| 3,242,003 | Brown |
| 3,341,354 | Woods et al |
| 3,345,933 | Glaus |
| 3,345,973 | Glaus |
| 3,364,055 | Nelson |
| 3,365,325 | Fraenkel et al |
| 3,526,535 | Plumat |

Curtain Coating Picture Frames, by Ward, D. March, 1960, Wilco Machine Works, Inc., Memphis, Tenn. Reprinted from Hitchcock's Wood Working Dig., December, 1959.

OBJECTS OF THE INVENTION

It is a general object of this invention to provide improved apparatus for applying one or more coatings of phosphor or other CRT screen material to the inside surface of a cathode ray tube front panel, particularly to the inside surface of a skirtless cathode ray tube front panel.

It is another object of this invention to provide apparatus for applying such coatings in a way which is substantially faster than prior art methods.

It is another object of this invention to provide apparatus for applying such coatings in a way such that the excess coating material which does not adhere to the front panel surface remains substantially free from contaminants and retains the content uniformity of unused coating material, so that the excess material may be reclaimed and directly combined with unused coating material.

It is still another object of this invention to provide apparatus for applying a uniform liquid coating over the concave inside surfaces of skirtless, spherically or cylindrically curved cathode ray tube front panels.

It is yet another object of this invention to provide apparatus for applying phosphor coatings to skirtless cathode ray tube panels in a way which is relatively insensitive to variations in the viscocity of the coating material, but which is readily adjustable to compensate for variations in the phosphor content of the applied coating material.

BRIEF DESCRIPTION OF THE DRAWINGS

The features of this invention which are believed to be new are set forth with particularity in the appended claims. The invention, together with further objects and advantages thereof may be best understood by reference to the following description in conjunction with the accompanying drawings in which like numbers refer to like elements and in which:

DESCRIPTION OF THE PREFERRED EMBODIMENT

As described above, a number of problems exist when applying a slurry coating to a cathode ray tube front panel using the dispense and spin method. It was noted that the use of this or a similar method of applying a slurry coating to the surface of a skirtless panel might introduce even more problems. The invention to be described below is specifically directed to the solution of these problems in connection with applying a coating of phosphor or other material onto the surface of a skirtless cathode ray tube front panel.

Figures 1, 1A, 1B, 1C, 2:
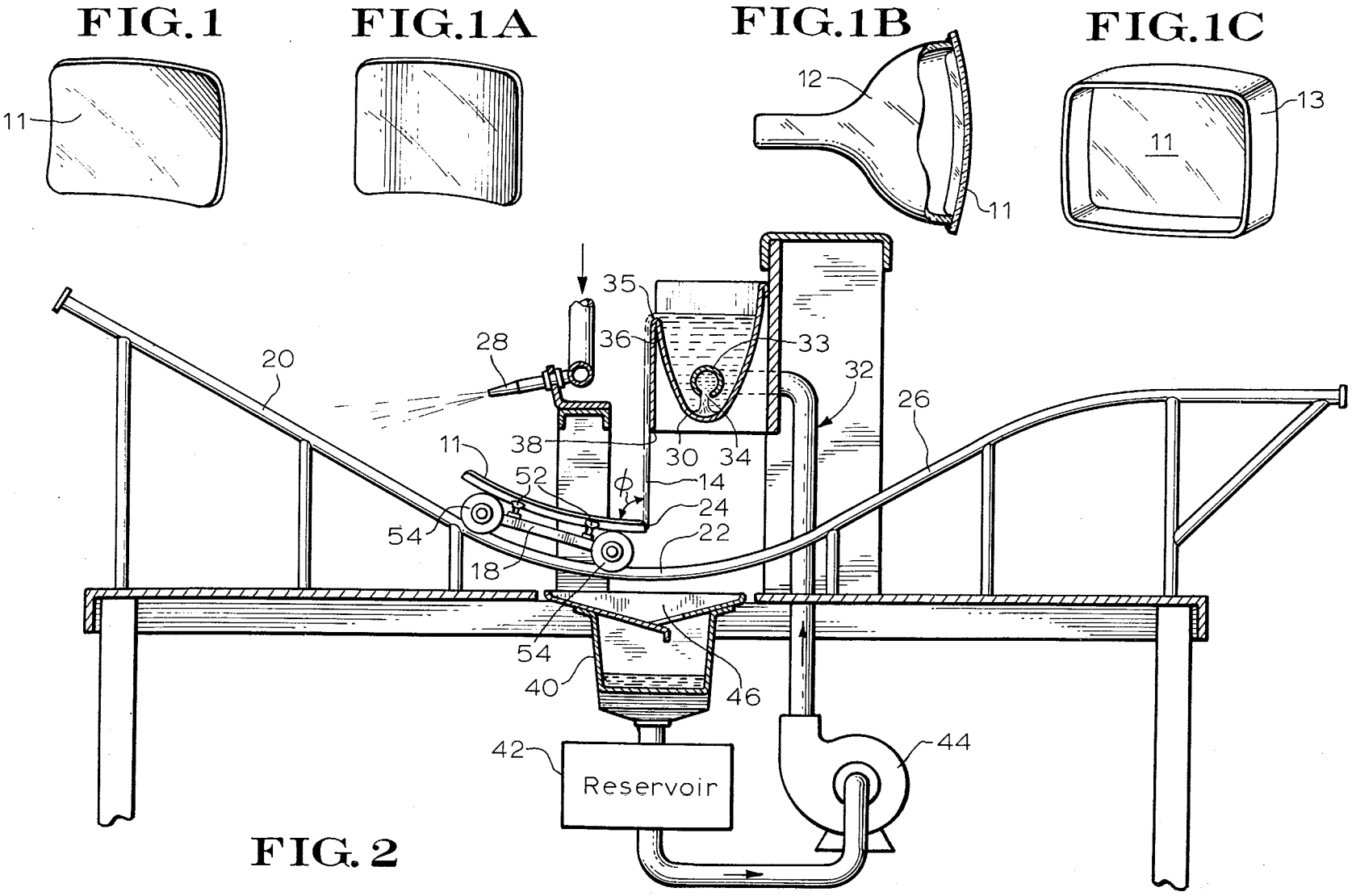
FIGS. 1 and 1A illlustrate schematically spherically and cylindrically shaped skirtless CRT front panels, respectively.
FIG. 1B illustrates a cathode ray tube and the way in which the front panel mates with the glass funnel.
FIG. 1C illustrates a conventional skirted CRT front panel.
FIG. 2 depicts schematically a curtain coating apparatus in accordance with the principles of this invention for applying a highly uniform coating of phosphor or other material onto a skirtless CRT front panel.

Before proceeding to a description of the present invention, a few remarks are in order regarding the cathode ray tube front panels which preferably are to be coated according to this invention. Typical examples of skirtless front panels are illustrated in FIGS. 1 and 1A. In FIG. 1, there is shown a spherically curved front panel 11 which is adapted to be bonded to the funnel of a cathode ray tube as shown in FIG. 1B. The panel 11 mates flush with the funnel 12 and is preferably attached thereto by a glass frit sealing process. The skirtless panel shown in FIG. 1A is cylindrical in shape and is bonded to a mating funnel also by a frit sealing process.

Panels of the type presently in commercial use resemble the FIG. 1C skirted panel. The skirt 13 wraps around and is an integral part of this type of panel. In the discussion above, the dispense and spin phosphor coating method was described in connection with the processing of a skirted front panel. In practicing that method, the panel is supported in a generally horizontal plane with its skirt 13 directed upwardly. After the slurry has been dispensed onto the upwardly facing surface, the panel is tilted and rotated in order to insure that the entire panel surface receives a uniform phosphor coating. That method is reasonably well suited to processing of skirted panels, despite the aforementioned deficiencies of that method, because the skirt 13 provides a convenient boundary for containing the dispensed slurry. However, in the case of the skirtless panels as shown in FIGS. 1 and 1A, the lack of a skirt to contain the slurry as the panel is tilted and spun precludes the use of this process. Keeping in mind this and the other above-described problems associated with the use of the dispense and spin phosphor coating method, the advantages of my invention will become apparent.

It is well known that certain objects, particularly flat objects, can be coated with a liquid material by means of a curtain coating process. In this process, a liquid curtain of the desired coating material is established in a generally vertical plane. The object to be coated is passed through the liquid curtain of coating material in a generally horizontal plane, as on a belt-type conveyor. That portion of the curtain which comes in contact with the object to be coated adheres to it and thus forms a liquid coating on the surface of the object.

The invention is specifically aimed at providing improved curtain coating structures for use in coating skirtless CRT front panels with one or more coatings of phosphor or other CRT screen materials.

In FIG. 2 there is illustrated a curtain coater representing a preferred structure for practicing this invention. A liquid curtain 14 of phosphor slurry, for example, is established having a width at least as wide as the object to be coated. A path through the curtain is established by means of a set of parallel tracks which describes a curved locus through the curtain along which panel 11 is conveyed. As shown, the tracks include an elevated, inclined section 20 and a lower, curved section 22. A wheeled panel support 18 supports the panel 11 and conveys it by force of gravity through the liquid curtain 14 along the path defined by the tracks in the manner of a roller coaster.

FIG. 2 shows a panel with its leading edge 24 contacting the curtain 14. As shown in FIG. 2, each elemental surface area of the panel as it passes though the curtain (more accurately, its direction vector) makes an angle "$\phi$" with respect to the curtain. The curved section 22 of the tracks and panel support 18 are both designed to convey the panel in a way which causes the angle $\phi$ to be preferably about 90° but preferably not greater than 90°. With an angle $\phi$ of 90° or less, the leading edge 24 of the panel 11 is less apt to tear or otherwise disrupt the curtain as it passes through. If the angle $\phi$ is about 90°, each consecutive elemental area of the panel is normal, or approximately normal, to the curtain element impinging it as the area is being coated, thus promoting coating uniformity. In the case of spherical (or other three dimensionally curved) panels, this is true only along a medial bisector of the panel extending in the direction of panel movement. The sides of the panel slope inwardly and the elemental surface areas thereof will unavoidably be slightly off normal.

After passing through the curtain, the panel is carried by its momentum up inclined section 26 of the tracks. Suitable means (not shown) may be provided for stopping the advance of panel support 18.

The curved section 22 of the tracks has a predetermined curvature through the liquid curtain 14 which is so related to the curvature of the panel as to produce a uniform coating on the coated object. Where the front panel to be coated has a radius of curvature, the curvature of the tracks is preferably in the form of an arc having a radius of curvature approximately equal to the radius of curvature of the panel.

Although the path along which a panel is conveyed preferably has a radius of curvature generally equal to the radius of curvature of the conveyed panel, no such limitation is intended. According to my invention, the curvature of the path through the curtain need only correspond to the curvature of the panel to a degree which will produce a coating of the desired uniformity. For example, it may be desirable in some cases to sharpen the curvature (decrease the radius of curvature in this case) of the path relative to the curvature of the panel in order to provide a greater concentration of coating material near the center of the panel. The correspondence between the curvature of the path and the curvature of the panel need, therefore, not be limited to a substantial equality between radii. In the case of a truly arcuate panel and path, the respective radii will, however, preferably be of the same order of magnitude, that is, one radius will be no greater than ten times the other.

Figure 3:
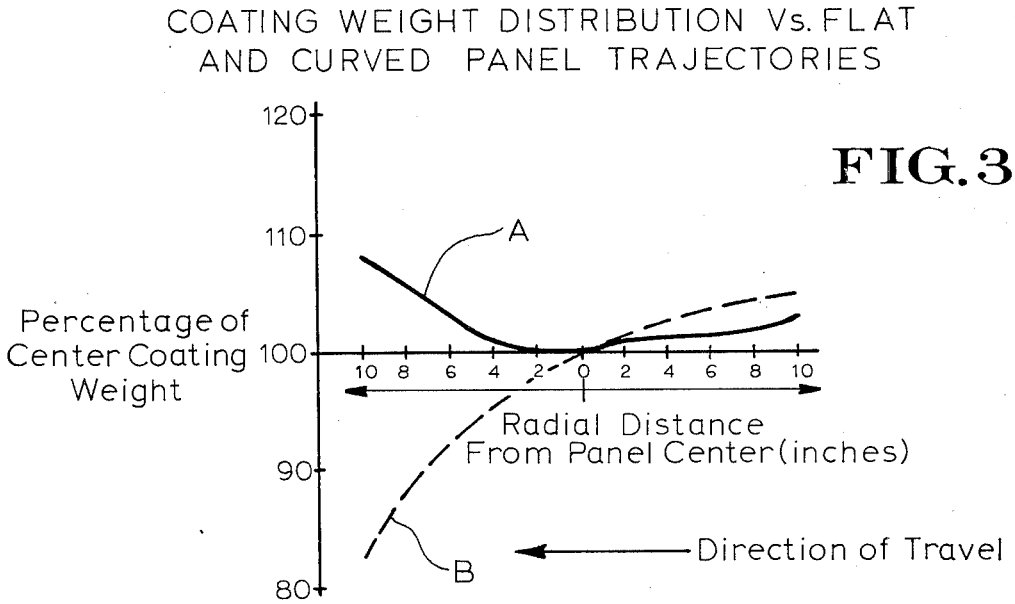
FIG. 3 is a graph which indicates the uniformity of phosphor coatings received by panels coated by the FIG. 2 apparatus and by prior art curtain coating methods.

The efficacy of coating a spherically-shaped panel in accordance with the teachings of this invention is illustrated graphically in FIG. 3. The graph indicates that a substantial improvement in coating uniformity can be obtained by the use of the rolle coaster-like apparatus of FIG. 2, rather than conveying a panel along a linear, horizontal path through the curtain. Curve A illustrates the case of a spherically-shaped panel which has been coated using the FIG. 2 apparatus. Note that the phosphor coating weight over a majority of the panel surface area is within 2 percent of the coating weight at the center of the panel. Curve B illustrates the case of the same spherically-shaped panel which was coated by conveying it along a flat linear path through the curtain. While the coating weight at the leading edge of the panel is nearly 8 percent greater than the center coating weight (curve A), it is still a substantial improvement over the 18% deviation in coating weight which resulted from conveying the same panel along the linear horizontal path through the curtain (curve B).

In the case of panels which are cylindrical in shape and which exhibit an arcuate curvature in one set of parallel planes, it is possible to provide material coatings which exhibit even greater uniformity than that indicated by the FIG. 3 graph. This can be effected by choosing a radius of curvature for the curved track 22 which is generally equal to the radius of curvature of the panel and, by conveying the panels through the curtain such that their direction of motion vectors lie in one of the parallel planes, each elemental surface area of such panels will meet the curtain at an angle of approximately 90°. By so maintaining each elemental surface areas of the panel approximately normal to the curtain when passing thereunder, it is possible to obtain a high degree of coating uniformity.

Having discussed the operation of the FIG. 2 apparatus in general terms, various aspects thereof will now be discussed in more detail. Referring again to FIG. 2, there is shown a static electricity neutralizer which consists of nozzles 28 for directing streams of de-ionized air onto the surface of panels as they are conveyed along the tracks. The blast of de-ionized air serves to assist in the removal of lint and other light, charged particles which cling to the panel surface.

Figure 4:
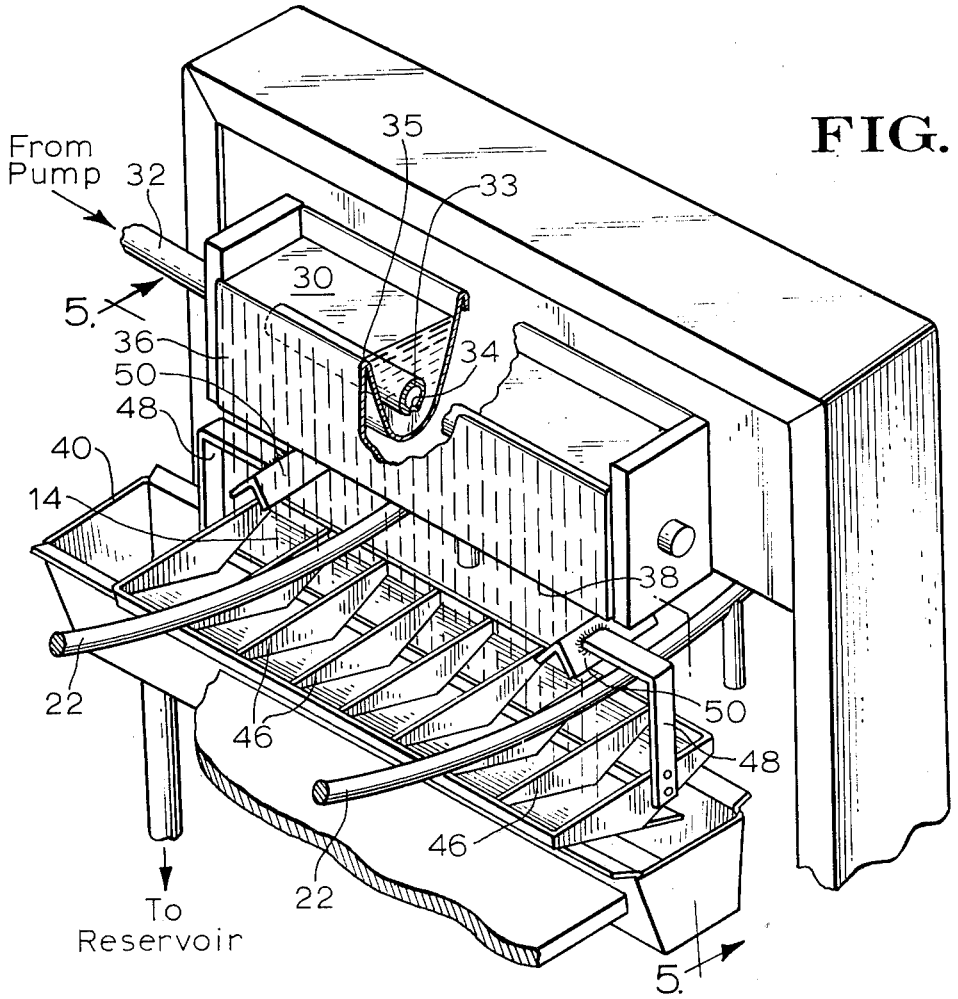
FIG. 4 gives a detailed perspective view, in schematic form, of the FIG. 2 curtain generating apparatus.

The way in which the liquid curtain of coating material is formed is illustrated in FIGS. 2 and 4. A basin 30 is provided with a supply of coating material through a conduit 32. The coating material enters cylinder 33 and is discharged downwardly into basin 30 through a series of downwardly facing apertures 34. When the level of the coating material is raised to the point where it is free to spill over the lip 35 of the basin, the material flows downwardly along the path defined by guide 36 which is provided with a knife edge 38 to insure the generation of a smooth, uniform liquid curtain.

When using this invention to apply a phosphor coating to a skirtless panel, the ingredients which make up the liquid curtain preferably include a water soluble photo-sensitizer, a water soluble acrylic or cellulose thickener, a polyvinyl alcohol binder and phosphor particles of one of the three primary colors. The viscosity of the slurry thus obtained is preferably 100 –300 centipoise to insure a good flow rate and to suspend the heavier phosphor particles in the slurry to avoid forming a phosphor sediment. The slurry is preferably 30–40 percent phosphor by weight, although the usable range is much broader (10–60 percent).

Maintaining the flow of slurry at 100–300 cubic centimeters per second will allow a curtain one meter wide (measured at the top of the curtain) to coat a 25 inch panel with a slurry coating sufficiently thick to provide the normal phosphor weight. This flow rate contemplates a panel movement through the curtain at a speed of 80–120 meters per minute.

Coating material which does not come in contact with a panel surface is collected in a pan 40 which is returned to a reservoir 42 for recycling back to basin 30 by means of pump 44. This arrangement makes evident an advantage of coating a panel in this way; namely, that the coating material which is collected in pan 40 may be recycled without the need to make corrections or additions thereto before combining the recycled material directly with unused material. This is possible because whatever part of the curtain that comes into contact with a panel will adhere to the panel rather than running off with contaminants which may be picked up from the surface of the panel. That part of the curtain which does not contact a panel is not contaminated and may be recycled directly.

Referring now to FIG. 4, details of the curtain coater are shown which were either not visible or omitted for purposes of clarity in the FIG. 2 illustration. Pan 40 is shown as containing baffles 46 which prevent splashing of the coating material. Supported by angle irons 48 are two deflectors 50 which are positioned directly above that portion of curved track sections 22 which lie beneath the liquid curtain. The purpose of the deflectors is to deflect the slurry coating around track sections 22 and to thereby prevent a slurry build-up on the tracks which could impair the movement of wheeled panel support 18 thereupon.

Figure 5:
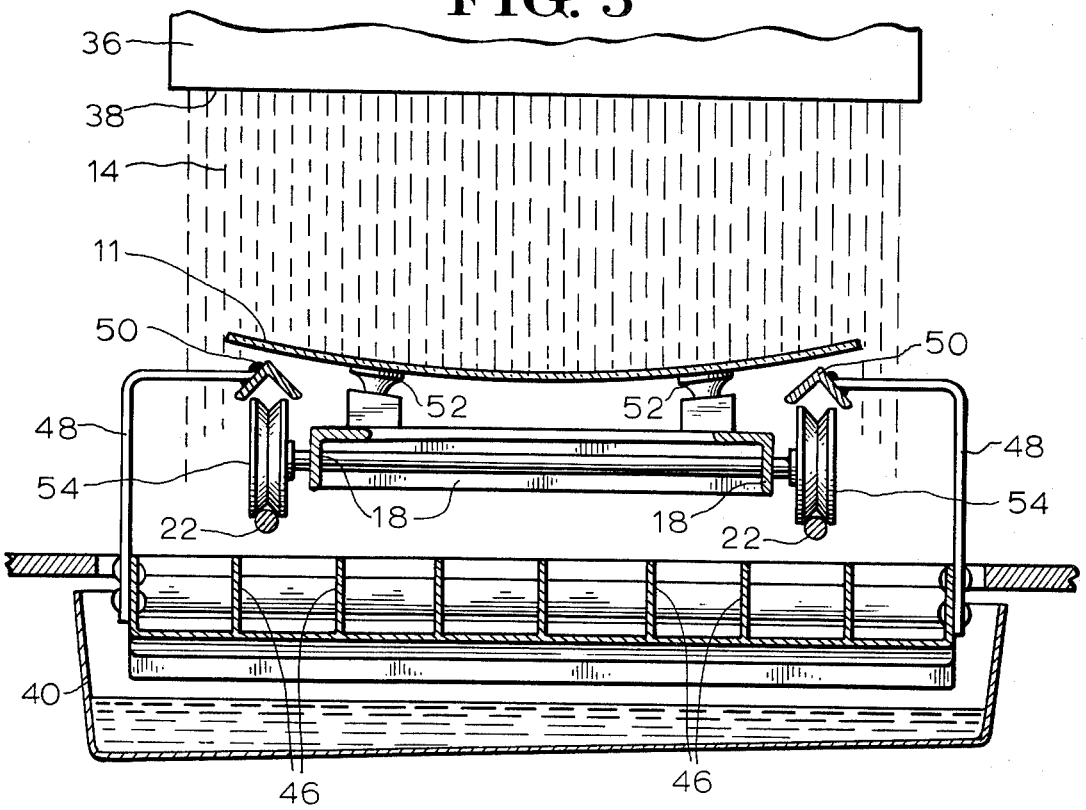
FIG. 5 is a sectional view depicting schematically the construction of a panel support used with the FIG. 2 apparatus and certain features of the FIG. 4 apparatus.

Details of the construction of panel support 18 are more evident in the FIG. 5 illustration. Each panel support 18 is provided with four suction cups 52 which are mounted on the panel support and adapted to hold a panel 11 throughout its conveyance along the track. The wheels 54 of panel support 18 are provided with V-shaped grooves which enable the panel support to follow the tracks and to ride above a small amount of coating material which may adhere to the upper surfaces of the tracks.

Having described the details of one of the contemplated embodiments of this invention, the important aspects thereof may be more succinctly stated as follows: the conveying of panels through a liquid curtain with their inside curved surfaces facing upwardly; the path along which the panels are conveyed is given a predetermined curvature through the curtain which corresponds generally to the curvature of the panels themselves in order to deposit a substantially uniform coating of slurry or other material on each panel.

In accordance with one aspect of this invention, each panel is conveyed along a path which has an effective curvature through the curtain such that the curtain contacts consecutive elemental surface areas of the panels at substantially the same angle during the time the panel is conveyed through the curtain. Where a panel is said to enter the curtain with its leading edge first and its trailing edge last, this angle is preferably about 90° as measured between the curtain and a point on the upwardly facing panel surface, which point lies on a line connecting the midpoint of the leading edge with the midpoint of the trailing edge of the panel.

It is clear from the above that many advantages accrue from the use of apparatus according to this invention. In addition to those described above, a number of others are manifest.

An important advantage which this invention provides is that a panel may be coated much faster than by prior coating methods. The coating process described above may be completed in one second or less, which compares very favorably with the 1–2 minutes required by the dispense-and-spin coating method.

Second, the phosphor weight of the slurry coating which adheres to the panel surface is easily adjustable by varying either the speed of the panel as it passes through the curtain (preferably by adjusting the height of its fall) or by varying the rate of flow of the slurry itself. The rate of flow of the slurry is most easily adjusted by changing the speed of pump 44. In connection with this advantage, it should be noted that the resultant phosphor weight of the slurry which adheres to the panel surface is substantially independent of certain other parameters of the slurry such as viscosity. It is dependent only upon the phosphor content of the slurry itself, the rate of flow of the slurry, and the speed of the panel as it passes through the curtain. In contrast thereto, the phosphor content of the slurry which adheres to a panel surface which has been coated by the dispense and spin method is quite dependent upon the viscosity of the slurry. Because the dispense and spin method coats the panel by creating a slurry puddle on the inverted panel surface and then spinning the panel to force the slurry to move over the panel surface in order to generate the preferred coating thickness, it is evident that the viscosity of the slurry is a parameter which must be closely controlled when using that process.

Many variations are contemplated in the details of the curtain dispenser, in the panel support and in the means for conveying the panel through the curtain, all of which are within the scope of the invention.

Figure 6:
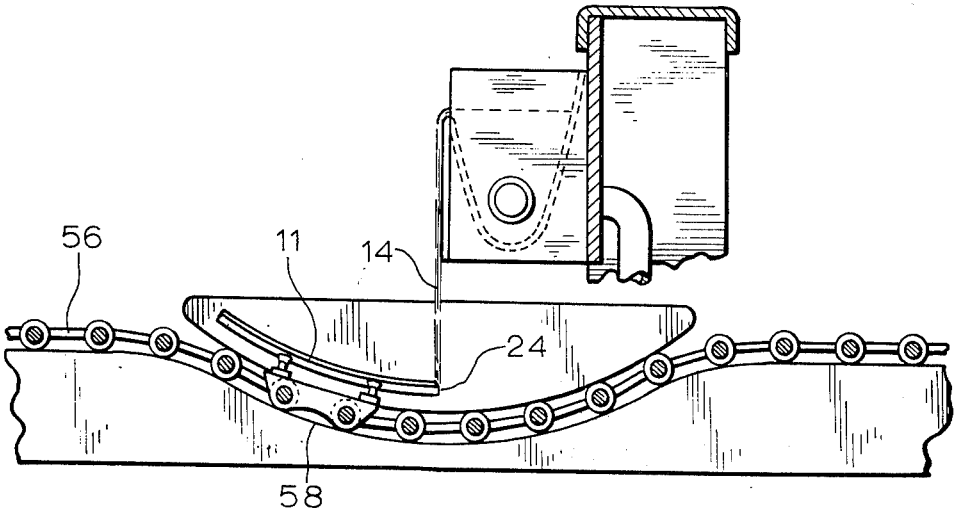
FIG. 6 is a side view schematically depicting an alternative embodiment of this invention.

FIG. 6 illustrates, in a side view, an alternative embodiment of this invention in which the panel movement is effected by a moving conveyor 56 rather than by gravity. In this embodiment, conveyor 56 follows a path 58 which defines an arc beneath curtain 14 and which has a radius of curvature generally equal to the radius of curvature of the panel 11. As in FIG. 2, this FIG. 6 embodiment also causes the angle $\phi$ (not shown in FIG. 6) to be preferably about 90°, but preferably not less than 90°, to promote coating uniformity and to prevent the leading edge of panel 11 from tearing the curtain as it passes thereunder.

The speed with which panel 11 passes through curtain 14 may be somewhat less than the speed with which panels proceed in the FIG. 2 embodiment. However, the rate of flow of slurry may be adjusted to compensate for this difference in speed and may thus be adapted to provide a slurry coating which is of a predetermined thickness, or as it is stated in the art, to provide a predetermined phosphor weight for panel 11.

Figure 7:
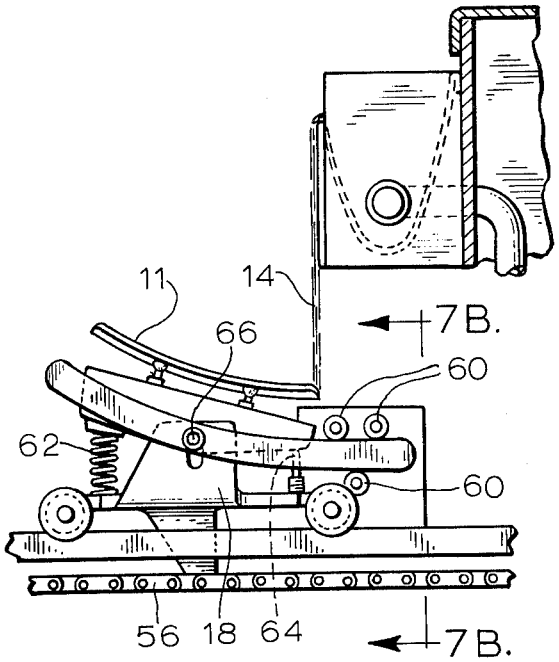
FIGS. 7, 7A and 7B depict, in schematic form, yet another embodiment of this invention.
Figure 7A:
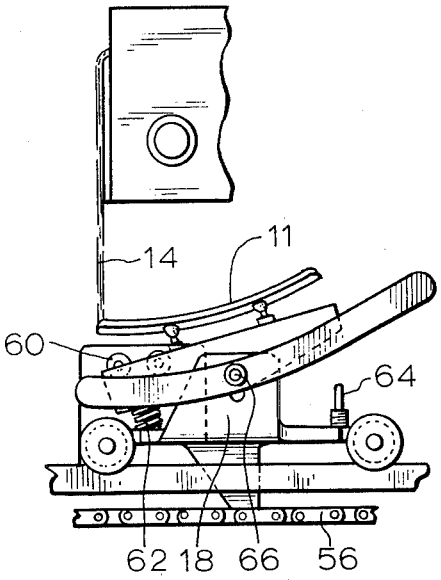
Figure 7B:
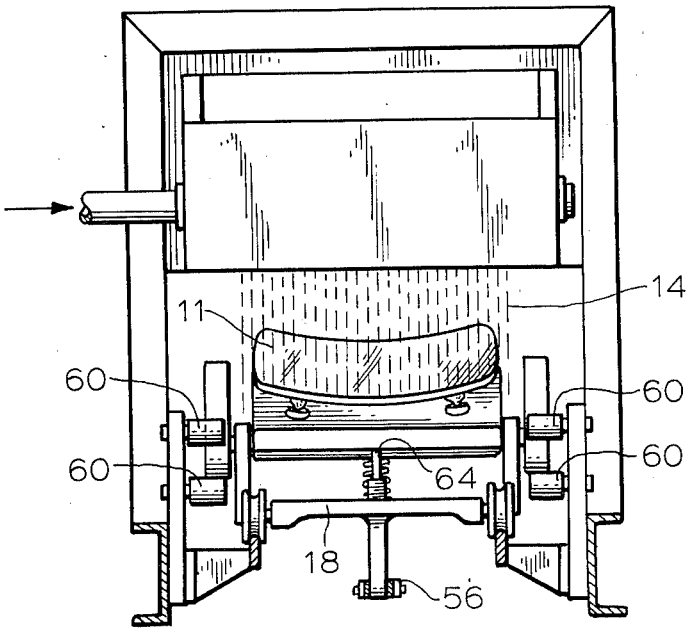

FIGS. 7, 7A and 7B illustrate another embodiment of this invention in which the panel movement is provided by a conveyor 56. In this embodiment, however, the conveyor passes beneath curtain 14 in a straight line. Panel 11 is effectively made to follow an arc whose radius of curvature is generally equal to the radius of curvature of the panel by the interaction of rollers 60, spring 62, post 64 and rotatable shaft 66. As illustrated in FIG. 7, panel 11 is conveyed to curtain 14 with the leading edge of the panel meeting the curtain at an angle appropriate to avoid tearing as discussed above. Panel support 18 then engages rollers 60 as shown which, along with spring 62, exert a rotational force on panel support 30 which causes it and its associated panel to rotate around the axis of shaft 66 so that, in passing under curtain 12, the movement of panel 11 defines the described arc.

FIG. 7A illustrates the position of the panel as it leaves the curtain and how spring 62 compresses to allow the panel to rotate. FIG. 7B shows another view of this embodiment wherein the rollers 60 and the way in which they guide panel support 18 are more clearly shown.

Even though the conveyor of FIG. 7 moves along a straight line through the curtain, the panel itself is so conveyed and supported that the panel follows a path having an effective curvature which corresponds generally to the curvature of the panel, thus causing a substantially uniform coating to be applied to the inner panel surface.

It should be noted that also in the other embodiments described herein, the apparatus of this invention causes the panel support to be transported through the curtain in such a way that the panel support is effectively rotated as it passes through the curtain about an axis perpendicular to the direction of panel motion and parallel to the curtain so as to maintain the aforesaid angle $\phi$ approximately constant, preferably about 90°.

Other embodiments of this invention are contemplated but not shown. For example, the panels to be coated may be supported and swung under the influence of gravity on a pendulum structure beneath a cantilevered curtain former to cause the panels to move through the liquid curtain along a path which defines an arc through the curtain. By choosing an arc with a curvature which corresponds generally to the curvature of the panel and by swinging the panel through the curtain with its concave surface facing upwardly in a way which causes the leading edge of the panel to meet the curtain at the proper angle to avoid tearing, the curtain will contact consecutive elemental surface areas of the panel at substantially the same angle (preferably, but not necessarily, about 90°). The theory behind the pendulum approach is basically the same as that of the FIGS. 1–5 embodiment described above except that the pendulum approach limits the path through the curtain to a true arc. In both the pendulum and FIGS. 1–5 embodiments, the panel support falls through the curtain under the influence of gravity and in both embodiments the panel support is constrained to travel on a curved path through the curtain. In both embodiments the path is preferably arcuate and its nadir is directly beneath the curtain. In both embodiments the arcuate path preferably has the same radius as the panel. In all of the embodiments described above, the apparatus is designed to provide a path through the curtain which has a curvature related to the curvature of the panels so as to produce the high degree of uniformity in the coating received by the panel, but the path thereby formed is not limited to an arcuate path.

Although the discussion up to this point has been primarily directed toward apparatus which deposits a phosphor coating onto the front panel of a cathode ray tube, no such limitation is intended. The invention is intended to be used for the application of any liquid coating to a skirtless front panel of a picture tube. For example, the use of this invention is contemplated in the coating of the black carbon-type material which surrounds each color dot in modern high-brightness color picture tubes, as disclosed in U.S. Pat. No. 3,146,368, issued to J. P. Fiore et al. This invention is also adaptable for use in applying a phosphor coating to a skirtless front panel of a black-and-white picture tube.

While the invention has been described in conjunction with specific embodiments thereof, it is evident that many alterations, modifications and variations will be apparent to those skilled in the art in light of the above disclosure. Accordingly, it is intended to embrace such alterations, modifications and variations which fall within the spirit and scope of this invention as defined by the appended claims.

What is claimed is:

1. Apparatus for applying a coating of phosphor slurry or other liquid materials to the concave inside surface of a curved skirtless cathode ray tube front panel, comprising:

means for establishing a falling liquid curtain of said coating material; and means for conveying said panel with its concave surface facing upwardly along a predetermined path through said curtain, said path being caused to have a curvature through said curtain which corresponds generally to the curvature of said panel such that each consecutive elemental surface area of said panel meets the curtain at an angle of approximately 90°, as measured between the curtain and the direction vector of the elemental area, thereby producing a high degree of uniformity in the coating applied to the panel.

2. Apparatus for rapidly disposing a uniform coating of phosphor slurry or other material onto the concave inside surface of a curved skirtless cathode ray tube front panel, comprising:

dispensing means for establishing a falling liquid curtain of said material;

roller-coaster-like track means passing through said curtain and having a concave curvature beneath said curtain; and gravity driven panel support means for carrying said panel in a concave-side-up attitude and adapted to ride on and follow said track means under the influence of gravity through said curtain so as to deposit a uniform coating of said material on the concave surface of said panel.

3. The apparatus as defined in claim 2 wherein said track means includes a first section thereof which is elevated and downwardly inclined toward said curtain and a second lower concavely curved section thereof which is situated directly in said curtain, thus providing a path for said support means and its supported panel to coast down said inclined section and over said curved section through said curtain.

4. The apparatus according to claim 2 including means for collecting unused material from said curtain and for recycling said material directly back to said dispensing means for redispensation.

5. The apparatus according to claim 2 including means for adjusting the velocity of travel of said panel support means by selection of the initial height of said panel support means.

6. The apparatus defined by claim 5 wherein said panel support means is a four-wheeled cart.

7. The apparatus as defined in claim 2 wherein said panel has a radius of curvature, and wherein said second section of said track means has a radius of curvature approximately equal to the radius of curvature of said panel.

8. Apparatus for applying a uniform coating of phosphor slurry or other liquid coating material to the concave inside surface of a curved, skirtless color CRT front panel, comprising:

means for establishing a falling liquid curtain of said coating material; and conveying means including a panel support for transporting said panel through said curtain with its concave surface facing upwardly, said conveying means effectively causing said panel to rotate about an axis perpendicular to the direction of panel motion and parallel to the curtain as it passes through the curtain so as to maintain each elemental surface area of the front panel substantially perpendicular to the curtain as it passes therethrough.

9. Apparatus for applying a uniform coating of phosphor slurry or other liquid coating material to the concave inside surface of a curved, skirtless color CRT front panel, comprising:

means for establishing a falling liquid curtain of said coating material; and conveying means including a panel support for transporting said panel through said curtain with its concave surface facing upwardly, said conveying means including means providing for said panel support to fall under the influence of gravity while at the same time constraining said panel support to travel on a curved path whose nadir is directly beneath said curtain.

10. The apparatus defined by claim 9 wherein said panel has a radius of curvature, wherein said curved path is arcuate, and wherein the radius of said path is approximately equal to said radius of curvature of said panel.

* * * * *